United States Patent [19]

Goff

[11] 4,364,823

[45] Dec. 21, 1982

[54] APPARATUS FOR SEPARATING ABRASIVE BLASTING MEDIA FROM DEBRIS

[76] Inventor: James R. Goff, Rte. 1, Box 247AB, Seminole, Okla. 74868

[21] Appl. No.: 232,465

[22] Filed: Feb. 9, 1981

[51] Int. Cl.[3] ..... B07B 7/04

[52] U.S. Cl. ..... 209/135; 209/149; 209/154; 51/425; 51/429

[58] Field of Search ..... 209/133–137, 209/143, 146, 147, 149, 154; 51/429, 425, 424, 264

[56] References Cited

U.S. PATENT DOCUMENTS

| | | | |
|---|---|---|---|
| 2,635,745 | 4/1953 | Mead et al. | 209/137 X |
| 2,707,314 | 5/1955 | Horth | 209/135 X |
| 2,850,162 | 9/1958 | Widmer | 209/143 X |
| 3,005,547 | 10/1961 | Freeman | 209/32 |
| 3,269,532 | 8/1966 | Moore | 209/147 X |
| 3,900,969 | 8/1975 | Diehn | 51/424 |
| 3,934,372 | 1/1976 | Diehn et al. | 51/425 |
| 4,020,596 | 5/1977 | Bergh | 51/425 |
| 4,052,820 | 10/1977 | Bergh | 51/423 |
| 4,202,142 | 5/1980 | van Fossen | 51/425 |

FOREIGN PATENT DOCUMENTS

| | | | |
|---|---|---|---|
| 482361 | 6/1953 | Italy | 209/133 |
| 485557 | 10/1953 | Italy | 209/143 |
| 79/2058 | 4/1979 | South Africa . | |
| 1518785 | 7/1978 | United Kingdom . | |
| 1542495 | 3/1979 | United Kingdom . | |
| 1575477 | 9/1980 | United Kingdom . | |

OTHER PUBLICATIONS

*Blast Cleaning & Shot Peening,* Cleveland Metal Abrasive, Inc., Cleveland, Ohio, pp. 8–11.

*Primary Examiner*—Ralph J. Hill

*Attorney, Agent, or Firm*—Beveridge, DeGrandi and Kline

[57] ABSTRACT

An apparatus for separating debris from spent abrasive in an abrasive blasting apparatus in which the debris and spent abrasive are recirculated from a blast zone at high velocity along a recirculating chamber includes means for receiving debris and spent abrasive from the recirculating chamber and allowing a quantity of the debris and spent abrasive to collect thereby forming a pile of debris and spent abrasive with a face of the pile exposed to incoming debris and spent abrasive. The pile has an angle of repose whereby additional incoming debris and spent abrasive fall down the face to form a substantially unobstructed, vertical, uniform curtain of falling debris and spent abrasive. The apparatus includes means for providing a stream of fluid through the recirculating chamber, and means disposed below the receiving means for drawing off the stream of fluid from the recirculating chamber. The falling curtain of debris and spent abrasive is washed by the stream of fluid as it passes from the recirculating chamber to the drawing means to entrain the debris from the falling curtain in the stream of fluid.

7 Claims, 1 Drawing Figure

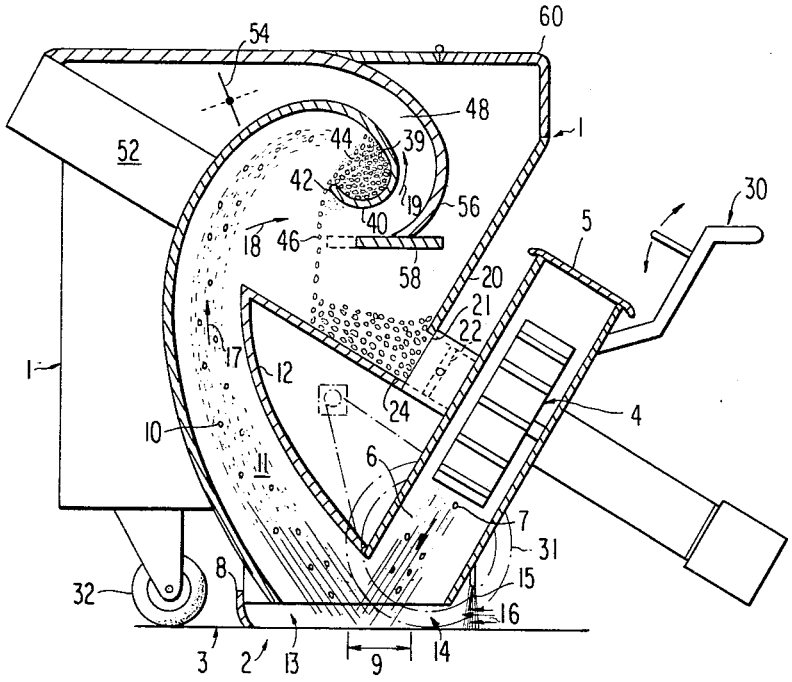
54
60
48
1
52
44
39
42
19
56
40
30
5
18
46
58
20
21
22
17
12
24
4
1
10
11
6
7
31
8
15
32
16
3
2
13
9
14

APPARATUS FOR SEPARATING ABRASIVE BLASTING MEDIA FROM DEBRIS

BACKGROUND OF THE INVENTION

The present invention relates to apparatus for separating spent abrasive blasting media from debris loosened by an abrasive blasting operation.

Abrasive blasting apparatus and methods have taken various forms. Generally, an abrasive medium such as sand or steel shot is propelled at high velocity at the surface to be treated. The combined features of the abrasiveness of the medium and the high velocity at which it is propelled causes the surface to abrade, generating debris such as dirt, paint, and rust from the treated surface, along with excessively fine abrasive media particles. The abrasive medium is reusable if the debris can be separated therefrom.

Various means have been employed in the art to allow the spent abrasive and debris to be reclaimed and to some extent, to separate them from one another.

For instance, British Pat. No. 1,542,495 to Worldwide Blast Cleaning, Ltd., discloses a device in which the spent abrasive and debris are carried up a reclaim channel by the kinetic energy of the abrasive medium. In this apparatus the reclaim channel opens into a hopper which acts also as a plenum, substantially decreasing the velocity of the air stream accompanying the abrasive medium and debris. The reduced velocity air stream no longer sustains the abrasive medium, but it does carry off the debris.

It is well known to separate debris from recycled abrasive media by the use of air washing methods. In these methods, the relative densities of the medium and contaminants are used to advantage, since the medium generally is more dense than the contaminants. The contaminated medium is caused to fall along a line in substantially continuous fashion so that a uniform "falling curtain" is obtained. An air stream is supplied through the falling curtain to entrain the contaminants and carry them away so that substantially uncontaminated abrasive medium can accumulate at the bottom of the curtain.

The uniformity of a falling curtain is important because voids or openings in the curtain allow the air to pass uninhibited and at increased velocity. The resulting increased velocity at the fringes of such a void or opening removes useable large abrasive particles. The reduced air stream velocity and volume in the remainder of the curtain results in incomplete washing.

There is a need in the art for an apparatus for separating debris from spent abrasive in an abrasive blasting apparatus in which the separation is very completely effected by the formation of a uniform falling curtain, and in which auxiliary air flows for air washing can be avoided.

SUMMARY OF THE INVENTION

The present invention fulfills this need by providing an apparatus for separating debris from spent abrasive in an abrasive blasting apparatus in which the debris and spent abrasive are recirculated from a blast zone at high speed along a recirculating chamber including means for receiving debris and spent abrasive from the recirculating chamber and allowing a quantity of the debris and spent abrasive to collect, forming a pile of debris and spent abrasive with a face of the pile exposed to incoming debris and spent abrasive from the recirculating chamber having an angle of repose whereby additional incoming debris and spent abrasive fall down the face to form an unobstructed uniform curtain of falling debris and spent abrasive. Means for providing a stream of fluid through the recirculating chamber and means disposed below the receiving means for drawing off the stream of fluid from the recirculating chamber are also provided. The falling curtain of debris and spent abrasive are washed by the stream of fluid as it passes from the recirculating chamber to the drawing means to entrain the debris from the falling curtain in the stream of fluid.

The receiving means can take the form of a cavity having an opening facing the recirculation chamber and a substantially horizontal floor on which the pile of debris and spent abrasive forms. Preferably, the floor of the cavity has a lip adjacent to the opening shaped to facilitate the passage of air from the recirculation chamber to the drawing means.

The drawing means can take the form of a duct means with an entrance facing the recirculation chamber. The drawing means can include a valve for controlling the rate of flow of the stream of fluid. Preferably, the drawing means has a lower side, which is variable in length. Mobile blasting apparatus can very advantageously be designed to use the principles of the invention.

BRIEF DESCRIPTION OF THE DRAWING

This invention will be more fully understood by reference to the drawing, in which:

The FIGURE is a cross-sectional view of a preferred surface treating machine of this invention.

DETAILED DESCRIPTION OF A PREFERRED EMBODIMENT OF THE INVENTION

Referring to the FIGURE, there is depicted an abrasive throwing machine which, for example, is one adapted for treating a substantially flat, horizontal surface. The machine comprises an enclosure generally designated as 1. The enclosure has an opening 2 therein adapted to confront a surface 3 to be treated with abrasive material. A centrifugal, airless, blast wheel 4 is provided within chamber 5 for projecting a stream 6 of abrasive particles 7 at an inclined angle relative to the surface 3 to be treated. A resilient sealing means 8 is provided around the periphery of the opening 2. The resilient sealing means 8 contacts the surface 3 and substantially prevents the escape of spent abrasive from enclosure 1. Abrasive particles 7 strike surface 3 within a blast zone 9. Spent abrasive particles 10 rebound upwardly along a rebound path generally designated as 11. This rebound path is also inclined at an angle relative to the surface 3.

The rebounding particles 10 enter an elongated, substantially unobstructed chamber 12. A storage hopper 20 is interposed between chamber 12 and blast wheel 4. Chamber 12 connects the blast zone 9 with the blast wheel 4 via hopper 20 making it possible to return to the blast wheel 4 spent abrasive rebounding from the blast zone. Elongated chamber 12 gradually diminishes in cross-section from the blast zone 9 toward the hopper 20.

The top of hopper 20 can be provided with an openable hatch cover 60 to facilitate access to the interior of the device for the addition of abrasive, servicing, and the like.

The enclosure employed in the apparatus of this invention is generally made of light-weight material, such as thin-guage steel or aluminum. Portions of the enclosure can be lined with a replaceable, abrasion-resistant material. For example, with reference to the FIGURE, the housing 5 in which the blast wheel 4 is installed can be lined with manganese steel, cast alloys or hardened plate. This is conveniently accomplished by using replaceable liners of the type well known in the art. Similarly, other surfaces of the enclosure subjected to wear can be lined with abrasion-resistant material.

The opening 2 in the enclosure 1 has a front area generally designated as 13 in the FIGURE and a rear area generally designated as 14. The front area 13 and the rear area 14 are outside the blast zone 9, but within the area bounded by seal 8. During operation of the device depicted in the FIGURE, there is a tendency for a small amount of spent abrasive to collect in the rear area 14. It is advantageous to recirculate this spent abrasive even though the quantity might be quite small. This can be accomplished by providing means for forcing spent abrasive in the rear area 14 back into the blast zone 9 in order that fresh abrasive 7 will strike the spent abrasive lying on surface 3 and blast it from the surface along the rebound path 11. This can conveniently be accomplished by applying suction through a dust collector 52 and providing for the entry of a fluid, such as a gas, preferably air, in the rear area 14. For instance, a portion of the resilient seal 8 adjacent rear area 14 may have at least one passage to permit the entry of the air from outside enclosure 1. Preferably, this portion of the resilient seal comprises a resilient brush means 15 adjacent to the rear area 14. Brush means 15 permits the flow of air along the path generally indicated as 16 in the FIGURE. This flow of air passes over the blast zone 9 and through the enclosure along the rebound path 11 and recycle path defined by 17, 18 and 19.

This flow of gas through the blast zone and along the recycle path makes a significant contribution toward returning spent abrasive to the blast wheel 4. The energy of the rebounding particles and the force on these particles by the flowing gas are together sufficient to carry the spent abrasive particles 10 to cavity 39. This result can be enhanced by diminishing the cross-section of elongated chamber 12. As the gas travels through chamber 12, its velocity increases because of the diminishing cross-section of the chamber. Thus, as the rebounding spent abrasive particles gradually lose their kinetic energy while moving upwardly, this energy loss is at least partially compensated for by the gradually increasing velocity of gas. The diminishing cross-section of the chamber 12 also converts the uncontrolled stream of rebounding particles 10 into a controlled stream that can be guided and directed to the cavity 39. It is to be understood that the diminishing cross-section is a preferred, but not essential feature.

The controlled stream of rebounding abrasive 11 and debris, which have been loosened from surface 3, are received in cavity 39 and collect in its receiving trough 40. Trough 40 has a lip 42 behind and above which the abrasive and debris build up to form a pile 44, as shown in the FIGURE. Eventually, the accumulation of abrasive and debris is such that additional debris and abrasive fall off of the pile or, in colliding with the pile 44, cause pile constituents to fall downwardly as at 46.

The kinetic energy of the abrasive reaching the pile is very great; it can have a speed on the order of about 200 to about 300 feet per second. The built-up pile of abrasive and debris, rather than the equipment, absorbs this energy, greatly decreasing the wear on the walls of cavity 39. The decrease is so great that it is sometimes possible to dispense with heavy wear plates in the region, making the machine lighter and easier to handle. The absorption of the kinetic energy of the incoming abrasive causes the pile 44 of abrasive and debris in trough 40 to be in a dynamic equilibrium so that the shape and size of the pile remain relatively constant despite the addition of incoming material and loss of the falling material. Thus, the pile maintains a uniform angle of repose (of typically 45° to the vertical), and the dynamic equilibrium causes abrasive and debris to fall uniformly over lip 42 across its width. This effect is enhanced if the incoming abrasive and debris from reclaim chamber 12 are evenly distributed across its width (i.e., into and out of the plane of the FIGURE).

The air stream in the recirculating chamber 12 is drawn off through a hood-shaped duct 48 to a suitable dust collector system 52.

Advantageously, duct 48 is provided with a valve, such as air gate 54, for controlling the volume of air drawn off. Gate 54 may be pivotably mounted in duct 48 to allow it to be oriented to substantially restrict the volume of air as shown in full lines in the FIGURE, or to present very little impedance to air flow as shown in phantom, or any orientation in between, depending on operating conditions. When the blasting apparatus is mobile, the gate 54 is generally left open as much as possible to aid in the recirculation of abrasive and debris from the treated surface.

Gate 54 is of particular utility when the downstream apparatus is variable. Thus, if a dust collector 52 is employed, it will inhibit air flow, and in this event gate 54 is desirably open. If no such dust collector is used, then closing gate 54 at least partially will diminish the volume of air to optimum levels.

Duct 48 is suitably formed with a lower side 56 having an adjustable extension 58 so that the length of lower side 56 is variable. Extension 48 may be slidably mounted (not shown) in enclosure 1, with adjustable controls (not shown) on the outside of enclosure 1 for determining its placement.

As the abrasive and debris fall uniformly across the width of lip 42, they are air washed by the stream of air 18, 19, such that the debris will be entrained in the air stream 19. Preferably, lip 42 is curved, as shown, to facilitate the passage of air stream 18 from the recirculating chamber 12 to the duct 48. Air stream 19 with the entrained debris is directed to the dust collector 52 where the debris is removed and accumulated.

Variable extension 58 aids in preventing reusable abrasive from becoming entrained in air stream 19. This variability is particularly useful when the apparatus is to use different sizes of abrasive at different times. When smaller, lighter abrasive is used, the air stream 18, 19 will tend to deflect the falling curtain 46 toward the lower side 56, of duct 48. Extension 58 can be retracted, as shown in solid lines in the FIGURE, to prevent the curtain from striking it and the reusable abrasive from being entrained in air stream 19.

Larger, heavier abrasive will form a curtain that is deflected less, so that extension 58 can be slid toward the curtain without causing entrainment, but increasing the effectiveness of the air wash. When larger particles of abrasive media are used, larger particles of debris can be removed from surface 3 and directed up the chamber 12. As the large abrasive medium and large debris particles fall from pile 44, the air stream 18, 19 deflects the larger debris particles from the falling curtain toward lower side 56. If extension 58 is positioned as shown in phantom in the FIGURE (with its edge close to the falling curtain), the large debris will be more likely to be entrained in air stream 19, since the effective suction in duct 48 is presented close to the debris particles. At least, the large debris particles will fall on extension 58 from which they may be dislodged by later-arriving large debris particles and thus entrained.

After having been air washed, the abrasive particles fall into hopper 20 and are fed to the blast wheel 4 through an inlet port 21 having means 22 therein for controlling the rate of flow of the particles.

This invention is particularly well suited to the type of machine described—that is, one in which the abrasive medium and debris are recirculated by the rebound energy of the abrasive medium supplemented with an air flow. In this invention the air flow that supplements the rebound energy also acts to air wash the abrasive medium. If an auxiliary air flow were employed for air washing, it would tend to short circuit the air flow in the recirculation chamber and the recirculation of the abrasive medium and debris would be impaired.

The invention could also be used to advantage in a surface treating apparatus such as that described in U.S. Pat. No. 3,977,128 to James R. Goff in which the return of spent abrasive and debris is aided by rotating brushes.

Although the above-discussed preferred embodiment employs the invention in an apparatus for cleaning the top of a substantially flat, horizontal surface, it will be understood that the invention could also be used in apparatus for abrasive blasting the bottom of horizontal surfaces or the sides of vertical surfaces.

Any of the well-known means for projecting abrasive particles against a surface to be treated can be employed in the device of this invention. Any type of conventional abrasive material can be employed in the device of this invention. For example, one can use metal shot, slag, sand, volcanic ash, glass beads, metal oxide particles, zircon, garnet, carborundum, stone, and the like. The rotational speed of the blast wheel and the quantity of abrasive required can be readily determined with a minimum of experimentation.

The air 16 can be provided by means of a vacuum or a forced air system. For example, the enclosure could be connected to means for providing a vacuum within the enclosure, such as by connection to the dust collector system. Air could then enter the brush means 15 in the lower portion of the enclosure. When a vacuum system is employed, it is preferable to connect the storage hopper 20 to the blast wheel 4 by means of a substantially air-tight seal in order to prevent short-circuiting of the air flow. The air flow 16 can also be provided by means capable of supplying air at a positive pressure near the brush 15.

It has been found that the air flow 16 should be of substantially high volume and low pressure or vacuum. In the preferred device previously described, an air flow at about 3–10 inches water column and ambient temperature has been found to be adequate.

The apparatus can also be provided with a steering handle, such as 30 in the FIGURE. The apparatus can be self-propelled by providing one or more drive wheels 31 near the rear of the machine. A caster wheel assembly 32 can be provided in the front of the machine. Controls for regulating the speed and direction of the machine and the speed of the throwing device can be mounted on steering handle 30. It will be apparent that the rate of travel of the machine can be adapted to suit a particular application. Preferably, variable speed controls are provided.

It will be understood that this invention can be mobilized or incorporated in a stationary blasting operation. While the device has been described as being mobile and especially adapted for use in cleaning substantially flat, horizontal or inclined surfaces, the invention can be incorporated in any suitable blasting apparatus.

The device of this invention possesses several advantages. The device is compact, so that if used in a mobile machine, the resulting machine is quite maneuverable.

The built-up pile 44 of spent abrasive and debris in trough 40 absorbs the kinetic energy of incoming abrasive so that wear-resistant plates are not needed on trough 40. This results in decreased cost and the elimination of downtime for periodic plate replacement. It also results in reduced weight of the machine, making it more suitable for cleaning the tops of relatively weak structures, such as storage tanks.

The built-up pile is kept in a dynamic equilibrium by the incoming debris and spent abrasive so that the falling curtain is substantially uniform in density over its width. The resulting curtain permits very effective air washing of the spent abrasive.

The invention has the additional advantage that the portion of the device subjected to the impact of high velocity abrasive is free of moving parts that would otherwise be subject to wear.

Furthermore, the air washing of the spent abrasive can be accomplished by using the air flow in the recirculating chamber, eliminating the need to provide any auxiliary air flow.

The invention includes adjustment means so that the air washing conditions can be adapted to achieve efficient abrasive recovery even though the amount of debris or the size of abrasive may vary.

I claim:

1. An apparatus for separating debris from spent abrasive in an abrasive blasting apparatus in which the debris and spent abrasive mixed in a stream of fluid are recirculated from a blast zone at high speed through a recirculating chamber comprising means for providing said stream of fluid through said recirculating chamber;

means for receiving said debris and spent abrasive from said recirculating chamber and allowing a quantity of said debris and spent abrasive to collect thereby forming a pile of said debris and spent abrasive with a face of said pile exposed to substantially all of the incoming high speed debris and spent abrasive from said recirculating chamber; wherein said pile has an angle of repose whereby additional incoming debris and spent abrasive lose a substantial proportion of their kinetic energy upon impacting said face and fall down said face to form a substantially unobstructed, vertical, uniform curtain of falling debris and spent abrasive; and means having an opening disposed below said receiving means in direct communication with said recirculating chamber for drawing off said stream of fluid from said recirculating chamber, whereby said falling curtain is washed of debris by said stream of fluid by passing the stream of fluid from said recirculating chamber through said falling curtain and into said opening of said drawing means to thereby entrain said debris from said falling curtain in said stream of fluid.

2. An apparatus as claimed in claim 1 wherein said abrasive blasting apparatus is mobile.

3. An apparatus as claimed in claim 2 wherein said receiving means comprises a cavity having an opening facing said recirculation chamber and a floor on which said pile of debris and spent abrasive forms.

4. An apparatus as claimed in claim 3 wherein said floor of said cavity has a lip adjacent said opening, said lip being shaped to facilitate passage of said fluid from said recirculating chamber to said drawing means.

5. An apparatus as claimed in claim 2 wherein said drawing means comprises a duct means with an entrance facing said recirculation chamber.

6. An apparatus as claimed in claim 5 wherein said drawing means further comprises a valve means in said duct means for controlling the rate of flow of said stream of fluid.

7. An apparatus as claimed in any one of claims 1 to 6 wherein said drawing means has a lower side which is variable in length.

* * * * *